United States Patent [19]

Pfaff

[11] 4,280,241

[45] Jul. 28, 1981

[54] CHILD'S BOOK

[76] Inventor: Deborah L. Pfaff, 150 17th Ave., San Francisco, Calif. 94121

[21] Appl. No.: 86,151

[22] Filed: Oct. 18, 1979

[51] Int. Cl.[3] ..... B42C 19/06; B42D 3/00

[52] U.S. Cl. ..... 11/1 R; 11/2; 281/1; 281/29; 281/31; 281/35

[58] Field of Search ..... 35/35 E, 69; D19/26-31; 281/31, 33, 29; 11/1 AD, 1 R, 2

[56] References Cited

U.S. PATENT DOCUMENTS

| | | | |
|---|---|---|---|
| Re. 26,395 | 5/1968 | Schneider | 35/35 E |
| 1,405,134 | 1/1922 | Hoyme | 35/35 E |
| 3,257,128 | 6/1966 | Schneider | 281/29 X |
| 3,414,296 | 12/1968 | Schneider | 35/35 E |
| 3,566,481 | 3/1971 | Causer | 35/69 X |
| 3,715,816 | 2/1973 | White | 281/29 |
| 3,738,686 | 6/1973 | Morse | 281/33 X |
| 4,063,369 | 12/1977 | Hart | 281/31 X |

OTHER PUBLICATIONS

Booklet, "The Children's Design Center 1979", Geyser Rd. Saratoga Springs, New York, 12866.

*Primary Examiner*—Paul A. Bell
*Assistant Examiner*—John S, Brown
*Attorney, Agent, or Firm*—Leydig, Voit, Osann, Mayer & Holt, Ltd.

[57] ABSTRACT

A book with just a few leaves, the leaves being soft and thick and made by inserting foam plastic or rubber into pockets of material. The exterior of the book is preferably made from a continuous web of material. The book, primarily intended as a toy or novelty item, may vary from small enough to be held in the hands of a small child to large enough to use as a piece of furniture.

9 Claims, 16 Drawing Figures

CHILD'S BOOK

BACKGROUND OF THE INVENTION

1. Field of the invention

This invention relates to a novel book which has thick, soft leaves and to its method of manufacture. More specifically, the invention relates to a child's picture book having its covers and leaves made of foam plastic or rubber covered with cloth or other material to its process of construction and to the continuous web from which it is preferably constructed. The book is both a learning device and a cuddly, pillow-like toy for very young children.

2. Description of the prior art

Two patents to Friederich Schneider (U.S. Pat. No. 3,414,296 and U.S. Pat. No. Re. 26,395) disclose a kind of picture book for children which comprises a series or web of interconnected, foamed plastic or rubber sections which the patentee refers to as pages. There is no spine or binding in the book described in the Schneider patents and, therefore, the interconnected sections or pages either lay out flat or are folded back and forth on top of each other. In short, the Schneider article is not a book in the usual sense of the word.

SUMMARY OF THE INVENTION

In its broader aspects the present invention relates to a novel book construction in which the pages are of cloth or any other suitable material filled with foamed plastic or rubber. The book has relatively few leaves or pages and is primarily intended as a very small child's picture book which is soft and cuddly, free of any sharp edges and well adapted to make the child familiar with books at an early age. Because the leaves are, for example, a half inch thick, the youngster's small fingers can readily grasp and turn them.

For the sake of consistency, the individual, foam-filled components of the book will be referred to as "leaves" and their surfaces will be referred to as pages or book covers.

The construction of the book of the present invention is such that it can be readily made either on a large, commercial scale or by an individual from, for example, a mail order kit with almost equal ease. The entire exterior of the book, in its preferred embodiment, is made from a single strip of cloth, a plurality of rectangular, foam plastic inserts, needle and some thread. It can be sewn by hand or by machine in a short period of time. A typical book according to the invention has five leaves formed by covering five rectangular, polyurethane foam inserts of one-half inch thickness; such a book would thus be slightly more than two and one-half inches in thickness. A typical book is 7½ inches by 6 inches in its other dimensions. It weighs only a few ounces.

DESCRIPTION OF THE PREFERRED EMBODIMENT

Figure 1:
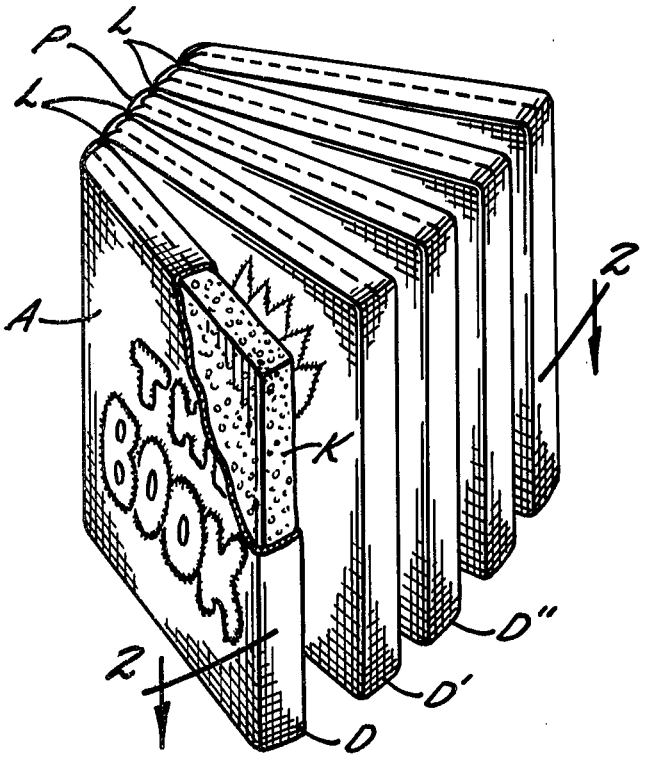
FIG. 1 is an overall, perspective view of a book having five, foam plastic-filled leaves. One of the corners of the cover and first leaf is shown with a portion of the covering material cut away to reveal the inner plastic foam.
Figure 2:
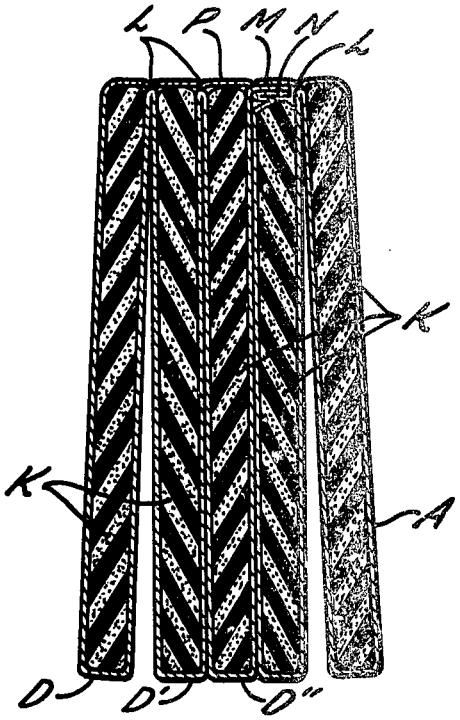
FIG. 2 is a plan view of the book in FIG. 1 sectioned along lines 2—2.
Figure 3A:
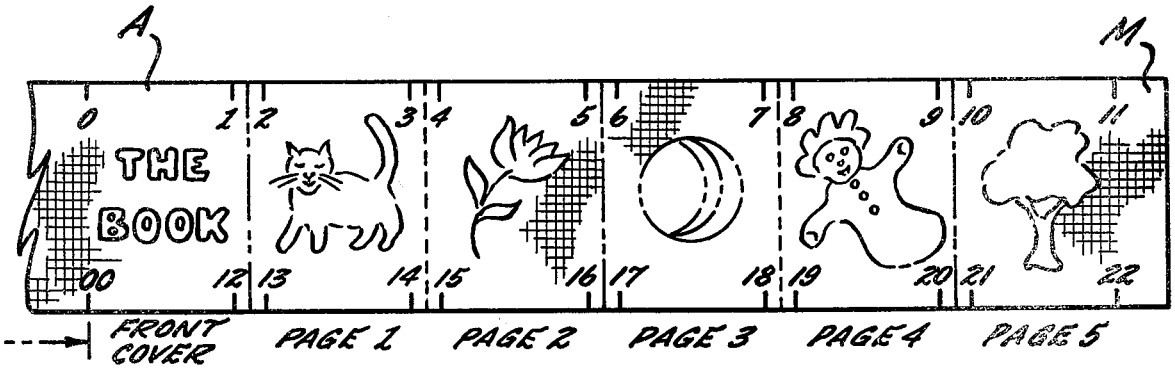
FIGS. 3*a* and 3*b* show the single web of material, e.g. a cotton textile, from which the exterior surfaces of the book are formed. Examples of the objects which may be depicted on the pages of the book are shown schematically. Identifying words are also preferably included.
Figure 3B:
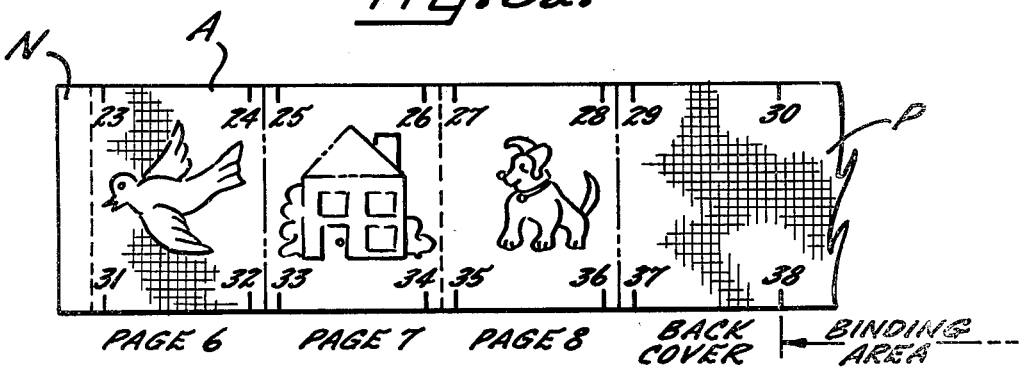

In the preferred embodiment of this invention the book shown in FIGS. 1 and 2, having five leaves, is made from a continuous web or foil of cloth A shown in FIGS. 3*a* and 3*b*, which web is approximately 68½" by 9". The book's final dimensions are an overall thickness of about two and one-half inches, a height of 7½ inches and a width of 6 inches.

The marks or "notches" numbered 0 and 00 through 38 in FIGS. 3*a* and 3*b* (and in the succeeding figures) are used for alignment of the respective sections of web A during construction of the book and must be located on web A in a precise manner for best results.

Referring to FIGS. 3*a* and 3*b*, and starting at the right-hand margin of web A, with the "right" side of the material facing up, the marks or notches, in the case of the particular size web herein described, are located as follows: a suitable seam allowance plus an extra one-quarter inch—one half the separation of leaves at the binding or spine—is provided for by placing the first two notches, 11 and 22, one inch to the left of the right-hand margin; notches 10 and 21 are then placed six inches (the eventual leaf width) from notches 11 and 22; notches 9 and 20 are located one half inch (the eventual leaf thickness) from notches 10 and 21; notches 8 and 19 are located six inches from notches 9 and 20 and the sequence is repeated until notches 0 and 00 are located six inches to the left of notches 1 and 12. At that point, in order to provide for what will be the binding or spine of the book the next notches, 30 and 38, are located two and one-half inches (equal to the thickness of the five eventual leaves) from 0 and 00 and then notches 29 and 37 are located six inches from 30 and 38; notches 28 and 36 are located one-half inch from notches 29 and 37; notches 27 and 35 are placed six inches from notches 28 and 36 and so on until notches 23 and 31 are located approximately one inch from the left-hand margin of web A, thus providing further seam allowance plus an additional quarter-inch for the reason indicated above. All notches should be made quite accurately at right angles to the longitudinal margins of the web prior to beginning to construct the pockets identified in some of the drawings as D and D'.

For purposes of explanation herein, FIG. 3*a* and FIG. 3*b* show the locations of fold lines (phantom) and the eventual stitch lines (dotted). It will be understood that neither the numbers nor the lines need actually be placed on the web in order to construct the book and that, indeed, if they were, they would have to be readily eraseable.

Figure 4:
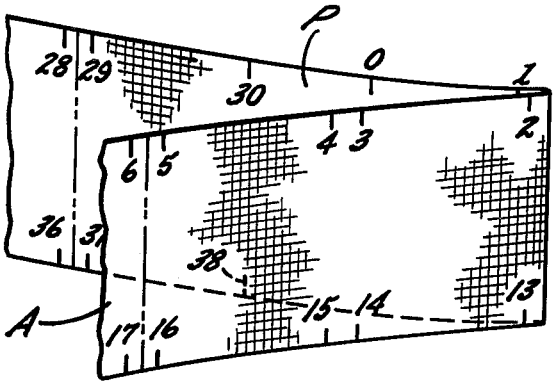
FIGS. 4–9 show the various stages of construction of the book's covering material while it is still wrong-side-out and prior to insertion of the rectangular foam inserts.

Referring now to FIG. 4, the "right" side of web A has been folded upon itself along a line intermediate the two sets of notches 1 and 2, and 12 and 13 so that such notches as well as notches 0 and 3 and 00 and 14 are exactly aligned as shown in FIG. 4.

Figure 5:
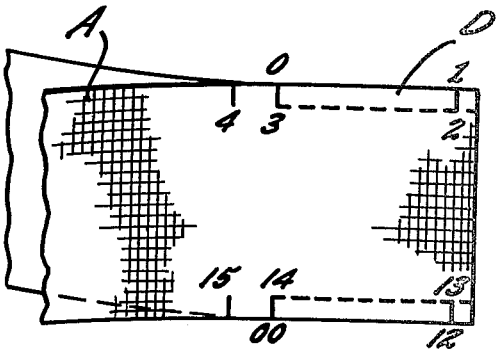

After thus aligning those notches, lines of stitches, paralleling the upper and lower margins of the web and one-half inch in from the respective margins, are run from notches 0 and 3 and notches 00 and 14 to the fold as shown in FIG. 5. Upon completion of these two lines of stitching the first pocket (still inside-out at this point) shown as D in FIG. 6 has been formed.

Figure 6:
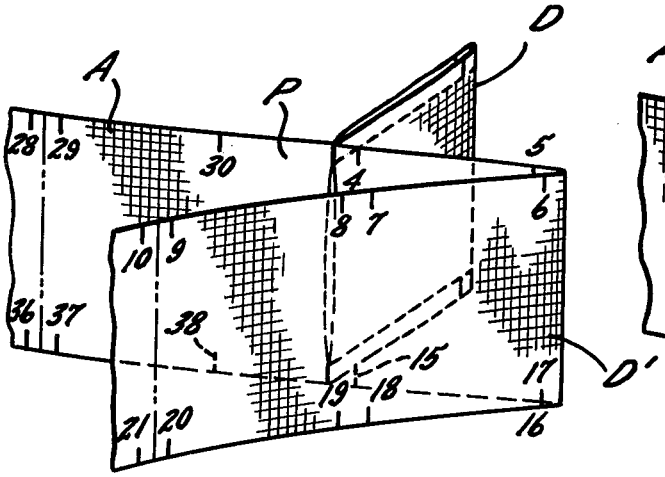
Figure 7:
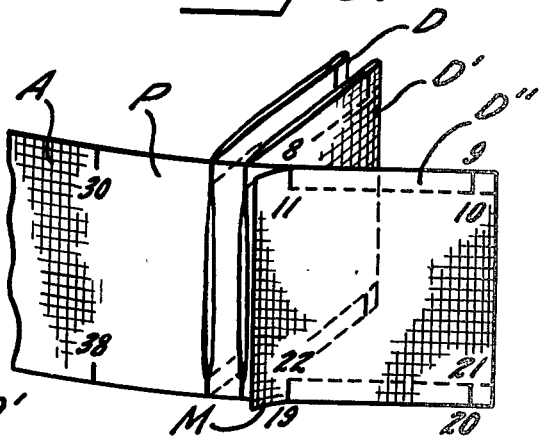
Figure 8:
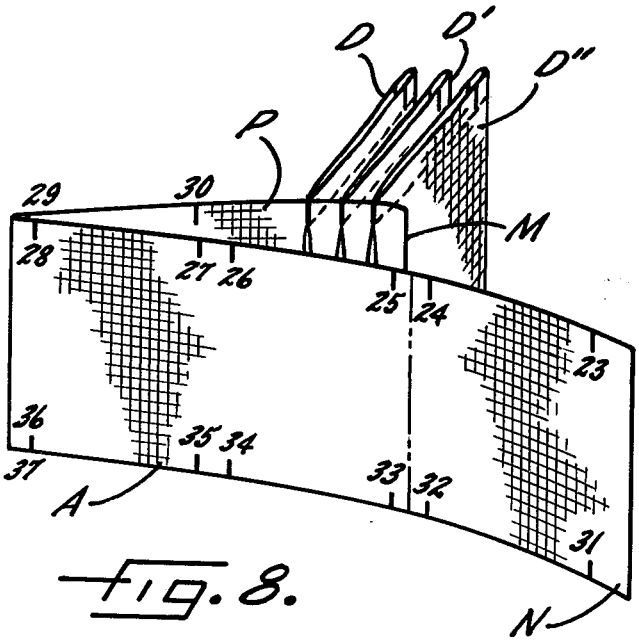
Figure 9:
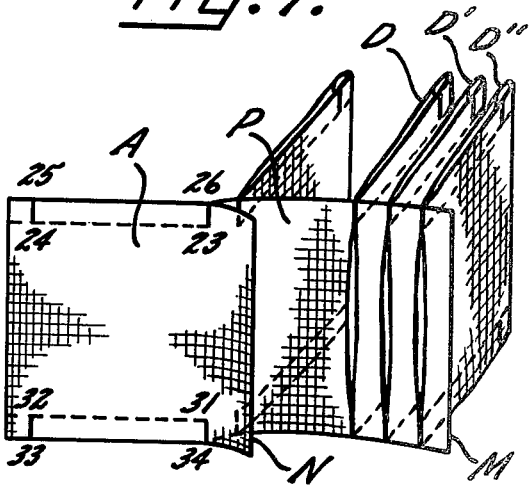

To form the second pocket D' (in FIG. 7), web A is first folded as shown in FIG. 6 along the line intermediate notches 5 and 6 on the top margin and 16 and 17 on the bottom margin. Once those notches are aligned and notches 4 and 7 are aligned with notches 15 and 18, two lines of stitches, one-half inch in from and parallel to the respective margins, are run from notches 4 and 7 on top and 15 and 18 on the bottom to the fold as shown in FIG. 7. In like manner, the remaining pockets are formed as shown in FIGS. 7–9.

Figure 11A:
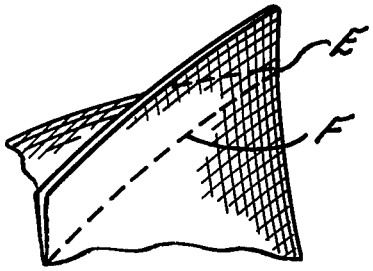
FIGS. 11*a*–11*c* are a series of enlarged views showing the construction of the squared corners of the leaf pockets prior to turning them right-side-out.
Figure 11B:
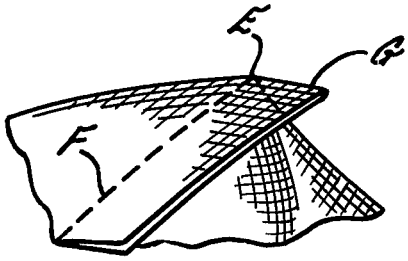
Figure 11C:
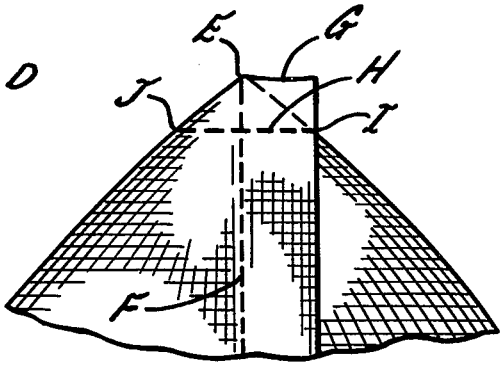

After having thus formed the five pockets, the final step, before turning them right-side-out, is to do the stitching shown in enlarged detail, in FIGS. 11*a*, 11*b* and 11*c* to form what will be squared corners on each of the leaves, after the pockets have been turned right-side-out. Such a squared corner is preferably formed by the steps of (1) holding an inside-out pocket in a vertical position; (2) flattening the pocket on a table or other surface so as to form apex E of the resulting triangular configuration with seam F bisecting the triangle; (3) fold flap G flat and stitch a one-half inch seam H perpendicular to seam F, i.e. extending a quarter inch on either side of seam F and forming the base of a triangle with termini at I and J. Such procedure should be carried out at the ten corners of the five pockets.

Figure 10:
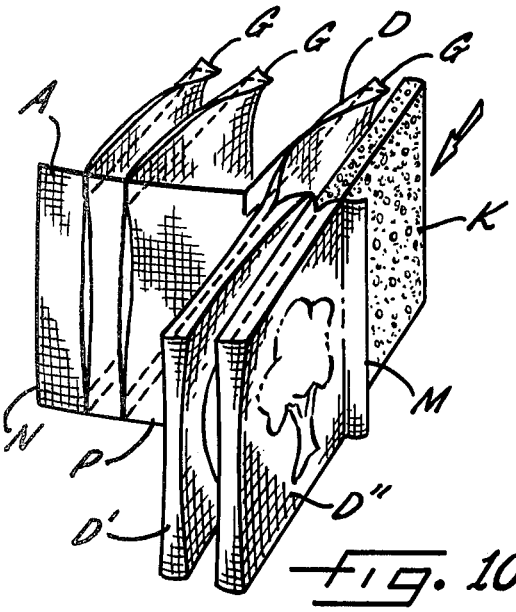
FIG. 10 shows two of the pocket-like leaf covers after they have been turned right-side-out and a foam insert is being introduced into one pocket. The other three pockets are still shown wrong-side-out.
Figure 12:
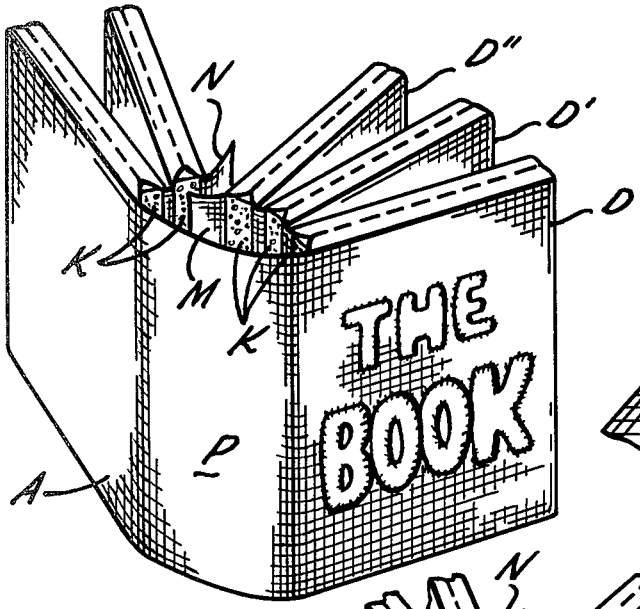
FIG. 12 shows the book after all pockets have been turned right-side-out and the foam slabs inserted therein—but before any of the final stitching has occurred which fixes the leaves to the spine or binding.
Figure 13:
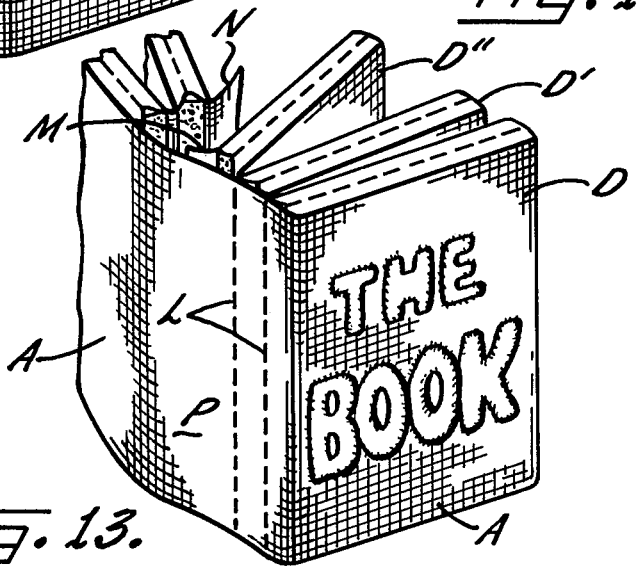
FIG. 13 is similar to FIG. 12 but with two lines of stitching shown fixing the first two pages to the spine or binding.

Once the squared corners have been made, the pockets may be turned right-side-out and, as shown in FIG. 10, the five foamed inserts K—sized to fit quite snugly in the pockets—are inserted. When all five inserts are in place, the book has reached the form shown in FIG. 12. The final stitching can then be carried out along the length of the binding area between each of the leaves as shown at L in FIG. 13. The ends M and N of web A are lapped, and a lengthwise seam (not shown) is stitched to fix the two together and at the same time attach the two ends to binding P. If desired, a final stitching, e.g. zigzag, may be used to close up the top and bottom openings between the backs of the pockets and the binding and thus prevent fingers, dirt, etc. from intruding.

While the foregoing description has been given in connection with a preferred embodiment of a book of a particular size constructed from a web of a particular size, it will be understood, of course, that the number of leaves and their dimensions, including leaf thickness, may be varied without departing in any way from the invention. Set forth below is an equation which can be used to determine the length of the web for a book of any desired dimensions.

$$n(2X+3Y)+2Z-Y=\text{Length of web}$$

where n = the number of leaves

X = the width of a leaf in inches

Y = the thickness of a leaf in inches

Z = the seam allowance in inches

The width of the web for any size book should be equal to the desired length of a leaf plus twice the seam allowance. And it has been found generally satisfactory to provide for a seam allowance of three-quarters of an inch. While the notches at each end of web A are one inch from the margin, only three-quarters of this is seam allowance with the remainder providing spacing distance between leaves.

Referring to the above equation and for purposes of example, calculating the length of a web to make a seven leaf book having leaves seven inches in width and one-quarter inch in thickness, it can readily be determined that the web should be 100.0 inches. Assuming further that the desired length of a leaf is eight inches, the width of the web should be nine and one-half inches. The notches would then be located in accordance with these same values of n, X, Y, and Z. The first notches would be placed about seven-eighths of an inch in from the margin, the next notches would be located seven inches therefrom, the next one-quarter inch further to the left, the next seven inches further on, etc. The section for the binding or spine, which would be an inch and three-quarters would likewise be provided for. The binding section may be anywhere on the web but it is preferred in the approximate center of the web.

Whereas a book of this type could theoretically be of almost any size, its use by a small child generally will dictate sizes such as have been described herein. The individual leaves can likewise vary fairly widely in thickness without departing from the invention, but again, for practical usage of the ultimate product and ease of construction, it is preferred that a leaf thickness of from about one-eighth inch to not more than about three-quarters of an inch be used. To demonstrate that the invention is in no sense limited dimensionally to a book which a child or even a parent could hold in his or her hand, a book having pages an inch or more in thickness and a length and width, for example, of several feet could be made as a model, a special novelty item, etc. and even used as a piece of furniture such as a table, seat or bed.

The web shown in the drawings is laid out with the multiple sections for the pages more or less evenly divided on either side of the binding section, but such a layout is only preferred and not essential. It is preferred because the final stitching which combines the free ends and attaches them to the binding ends up in a location between two internal leaves rather than, for example, on the outside of the book.

While the preferred embodiment of the book and its construction has been described in terms of forming seams by sewing, some or all of such seams may also be formed by other means, e.g. adhesive, Velcrol, etc. without departing from the spirit of the invention. From the standpoint of the child's safety, the permanence of the seams and the fun of constructing the book when the same is supplied in kit form, sewing is the preferred technique for forming the seams. The web material may be woven, non-woven, natural fiber, synthetic resin, etc. A readily washable material is preferred for reasons which are apparent to those familiar with the habits of small children. While described as continuous, in accordance with the preferred embodiment of the invention, it will be understood that the web need not necessarily be a continuous piece of the same material but can comprise a series of connected pieces of different color, texture, etc.

I claim as my invention:

1. A book having a plurality of leaves, each leaf comprising a core of flexible foam enclosed within a pocket of conforming material, the aligned, open ends of said foam-filled pockets being juxtaposed against and hinged to a binding, said pockets which comprise said leaves being formed from a substantially continuous web of said material.

2. The book of claim 1 wherein the sheet material is a textile.

3. The book of claim 3 wherein the textile is washable cloth.

4. A book having a plurality of leaves, each leaf comprising a core of flexible foam enclosed within a conforming sheet material, said leaves being connected to a binding along one set of their aligned margins, the exterior surface of the leaves and covers of said book comprising a continuous web of said sheet material.

5. The book of claim 4 wherein the continuous web of sheet material is a textile.

6. The book of claim 5 wherein the textile is a woven fabric.

7. The book of claim 4 wherein the continuous web of sheet material is a thermoplastic.

8. The method of constructing a book having a plurality of leaves, each leaf comprising a core of flexible foam enclosed within a conforming sheet material, said leaves being connected to a binding along one set of their aligned margins, wherein the exterior surface of the leaves and covers of said book is made from a continuous web of said sheet material, which method comprises the steps of (1) preparing the continuous web of said covering material having a width approximately equal to the desired length of a leaf plus twice the seam allowance and a length determined by the equation:

$$n(2X+3Y)+2Z-Y=\text{Length}$$

wherein n=the number of leaves

X=the desired width of a leaf

Y=the desired thickness of a leaf

Z=the seam allowance;

(2) inscribing along the longitudinal margins of said web between two sets of marks located approximately $Z+\frac{1}{2}Y$ from the end margins, a series of marks defining (a) alternating X and Y distances plus (b) a binding section defined by marks approximately nY apart; (3) forming the first foam-receiving pocket by folding the web, "right" side in, along a vertical line intermediate the marks defining any Y distance, then stitching the folded web in lines parallel to the longitudinal margins from the nearest X defining marks to said fold at a distance Y from said longitudinal margins; (4) repeating the pocket forming procedure step (3) with respect to each of the similarly marked sections; (5) stitching square corners on each of the outward ends of the pockets; (6) turning each pocket "right" side out; (7) inserting foam fillers in said pockets, and (8) stitching the leaves to the binding section.

9. A continuous web of sheet material adapted to form the exterior surface of the leaves and covers of a book having a plurality of leaves, each leaf comprising a core of flexible foam enclosed within a conforming sheet material, said leaves being connected to a binding along one set of their aligned margins, wherein the exterior surface of the leaves and covers of said book is made from a continuous web of said sheet material, said sheet material having a width approximately equal to the desired length of a leaf plus twice the seam allowance and a length determined by the equation:

$$n(2X+3Y)+2Z-Y=\text{Length}$$

wherein n=the number of leaves

X=the desired width of a leaf

Y=the desired thickness of a leaf

Z=the seam allowance;

said web having inscribed along both longitudinal margins a set of parallel marks approximately $Z+\frac{1}{2}Y$ from each end margin, a series of other parallel marks located between said two end sets defining alternating X and Y distances and a binding and the words or pictures which will eventuate as the indicia on the pages of the book being fixed on the right side of the web in the spaces bounded by the respective X-defining marks.

* * * * *

UNITED STATES PATENT AND TRADEMARK OFFICE

CERTIFICATE OF CORRECTION

PATENT NO. : 4,280,241

DATED : July 28, 1981

INVENTOR(S) : Deborah L. Pfaff

It is certified that error appears in the above—identified patent and that said Letters Patent is hereby corrected as shown below:

Claim 1, line 3, after "conforming" insert --sheet--.

Claim 3, line 1, change the numeral "3" to --2--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*